US010996010B2

(12) United States Patent
Cass

(10) Patent No.: US 10,996,010 B2
(45) Date of Patent: May 4, 2021

(54) LOCKING SYSTEM FOR REMOVABLE MAGAZINE FLOOR PLATES FOR FIREARM MAGAZINES

(71) Applicant: Pearce Grip, Inc., Fort Worth, TX (US)

(72) Inventor: Christopher Cass, Fort Worth, TX (US)

(73) Assignee: Pearce Grip, Inc., Fort Worth, TX (US)

( * ) Notice: Subject to any disclaimer, the term of this patent is extended or adjusted under 35 U.S.C. 154(b) by 0 days.

(21) Appl. No.: 16/523,295

(22) Filed: Jul. 26, 2019

(65) Prior Publication Data

US 2020/0103189 A1 Apr. 2, 2020

Related U.S. Application Data

(60) Provisional application No. 62/703,472, filed on Jul. 26, 2018.

(51) Int. Cl.
*F41A 9/71* (2006.01)
*F41A 9/65* (2006.01)

(52) U.S. Cl.
CPC . *F41A 9/71* (2013.01); *F41A 9/65* (2013.01)

(58) Field of Classification Search
CPC ..... F41A 9/65; F41A 9/71
See application file for complete search history.

(56) References Cited

U.S. PATENT DOCUMENTS

| | | | | |
|---|---|---|---|---|
| 5,526,600 | A * | 6/1996 | Chesnut | F41A 9/65 42/50 |
| 5,584,136 | A * | 12/1996 | Boland | F41A 9/71 42/50 |
| 5,642,582 | A * | 7/1997 | Grams | F41A 9/65 42/50 |
| 5,666,752 | A * | 9/1997 | Grams | F41A 9/71 42/49.02 |
| 6,557,287 | B2 * | 5/2003 | Wollmann | F41A 9/65 42/50 |
| 2005/0011097 | A1 * | 1/2005 | Freed | F41A 9/65 42/49.02 |
| 2013/0333261 | A1 * | 12/2013 | Clifton, Jr. | F41A 9/65 42/50 |
| 2017/0321979 | A1 * | 11/2017 | Szczepkowski | F41A 9/71 |
| 2018/0031342 | A1 * | 2/2018 | Faifer | F41A 9/70 |
| 2018/0051948 | A1 * | 2/2018 | Corso | F41A 9/65 |
| 2018/0347929 | A1 * | 12/2018 | Hsu | F41A 9/71 |
| 2019/0195584 | A1 * | 6/2019 | Thomele | F41A 9/69 |
| 2019/0285374 | A1 * | 9/2019 | Bowler | F41A 11/00 |
| 2020/0064092 | A1 * | 2/2020 | Pini | F41A 9/65 |

* cited by examiner

*Primary Examiner* — Gabriel J. Klein
(74) *Attorney, Agent, or Firm* — Chamberlain, Hrdlicka, White, Williams & Aughtry

(57) ABSTRACT

A magazine floor plate for a firearm magazine includes sidewalls that extend vertically from floor plate and define an interior cavity for accommodating a portion of the firearm magazine. The sidewalls include a first parallel longitudinal sidewall, a second parallel longitudinal sidewall, a first parallel traverse sidewall, and a second parallel traverse sidewall. The magazine floor plate further includes a locking mechanism for insertion between the firearm magazine and at least one of the sidewalls when the interior cavity accommodates the portion of the firearm magazine. The first and second parallel longitudinal sidewalls have a length greater than the firearm magazine.

20 Claims, 11 Drawing Sheets

LOCKING SYSTEM FOR REMOVABLE MAGAZINE FLOOR PLATES FOR FIREARM MAGAZINES

BACKGROUND

Many firearms utilize ammunition magazines to hold ammunition to be loaded into the firing chamber of the firearm. Handguns, and particularly semi-automatic handguns, often house an ammunition magazine in a cavity in the handle or grip portion.

The length of the handle or grip portion may vary and for some users the grip portion may not provide enough surface area for the user's entire hand. Often, users will extend the length of the grip portion by adding a magazine floor plate with more surface area. However, current methods for removing and adding a magazine floor plate require specific tools and intricate steps making it difficult for most users.

Accordingly, the need remains for a magazine floor plate that is easily attached and removed from a firearm magazine.

SUMMARY

In one aspect, a magazine floor plate for a firearm magazine in accordance with one or more embodiments of the invention includes sidewalls extending vertically from floor plate and defining an interior cavity that accommodate a portion of the firearm magazine. The sidewalls include a first parallel longitudinal sidewall, a second parallel longitudinal sidewall, a first parallel traverse sidewall, and a second parallel traverse sidewall. The magazine floor plate further includes a locking mechanism for insertion between the firearm magazine and at least one of the sidewalls when the interior cavity accommodates the portion of the firearm magazine. The first and second parallel longitudinal sidewalls have a length greater than the firearm magazine.

In one aspect, a magazine floor plate for a firearm magazine in accordance with one or more embodiments of the invention includes sidewalls defining an interior cavity, the sidewalls extend vertically from a floor plate; the interior cavity for receiving a portion of the firearm magazine, the interior cavity has a length greater than the portion of the firearm magazine; and a locking mechanism for insertion between the firearm magazine and at least one of the sidewalls when the interior cavity receives the portion of the firearm magazine.

In one aspect, a method of using a magazine floor plate for a firearm magazine in accordance with one or more embodiments of the invention includes providing a firearm magazine; providing a magazine floor plate, the magazine floor plate includes sidewalls extending vertically from the magazine floor plate and define an interior cavity adapted to accommodate the firearm magazine, the sidewalls include a first parallel longitudinal sidewall, a second parallel longitudinal sidewall, the first and second parallel longitudinal sidewalls have a length greater than the firearm magazine, a first parallel traverse sidewall, a second parallel traverse sidewall. The magazine floor plate further includes a locking mechanism for insertion between the firearm magazine and at least one of the sidewalls. The method and further includes causing the magazine floor plate to engage with the firearm magazine; and causing the locking mechanism to be inserted between and engage with the firearm magazine and the at least one of the sidewalls to prevent movement of the firearm magazine with respect to the magazine floor plate.

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Figure 1:
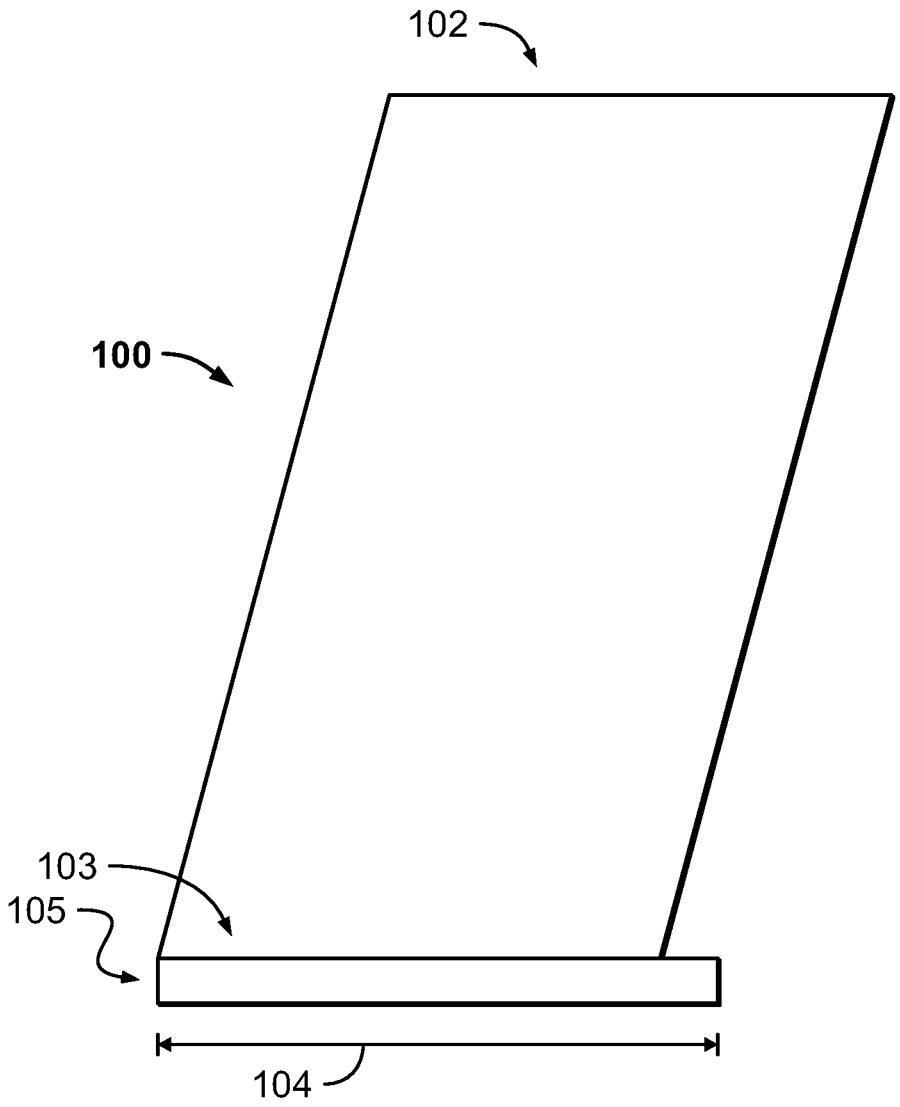
FIG. 1 shows a diagram of a firearm magazine in accordance with one or more embodiments of the invention.

Reference now should be made to the drawings, in which the same reference numbers are used throughout the different FIGUREs to designate the same components.

The terminology used herein is for the purpose of describing particular embodiments only and is not intended to be limiting. As used herein, the singular forms "a", "an", and "the" are intended to include the plural forms as well, unless the context clearly indicates otherwise. It may be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the FIGUREs to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

In general, embodiments of the invention relate to systems, devices, and methods for facilitating the reversible attachment of a floor plate to a magazine. A floor plate in accordance with one or more embodiments of the invention may be adapted to circumferentially attach to a portion of the magazine in a reversible manner. By circumferentially attaching to the portion of the magazine, an interior volume of the magazine may be left void by the attachment of the floor plate to the portion of the magazine. In contrast, other methods of attaching floor plates to magazines may impact or otherwise utilize a portion of the interior volume for the attachment.

A floor plate in accordance with one or more embodiments of the invention may include a body that is adapted to spatially extend one or more ergonomic features of a firearm to which the magazine is adapted to attach. The ergonomic features may be, for example, a portion of a handle. The portion of the handle may include texture, or other physical features, that improve the comfort and/or use of the firearm. A floor plate in accordance with embodiments of the invention may include a body that physically extends such features. By doing so, the physical features of the floor plate, in combination with those of a firearm, may be modified to meet a user's particular needs (e.g., hand size).

FIG. 1 shows a diagram of a firearm magazine 100 in accordance with one or more embodiments of the invention. The firearm magazine 100 may be adapted to hold one or more rounds of ammunition. The firearm magazine 100 may include an interior with a first opening 102 and a second opening 103. The first opening 102 may be adapted to receive ammunition into an interior of the magazine. The second opening 103 may be adapted to receive an internal locking floor plate 105.

An internal locking floor plate 105 may be a physical structure adapted to seal the second opening 103. To seal the second opening 103, a portion of the internal locking floor plate 105 may be adapted to enter the interior of the firearm magazine 100 and physically mate with an interior surface of the firearm magazine 100. By doing so, the internal locking floor plate 105 may be fixedly attached to the firearm magazine 100. However, by physically intruding into the interior of the firearm, the magazine 100 may prevent or otherwise limit the use of the second opening 103 for other purposes.

For example, by entering into the interior through the second opening 103, other objects such as, for example, ammunition rounds may be prevented from traversing through the second opening 103 while the internal locking floor plate 105 is physically attached to the firearm magazine 100.

Figure 2:
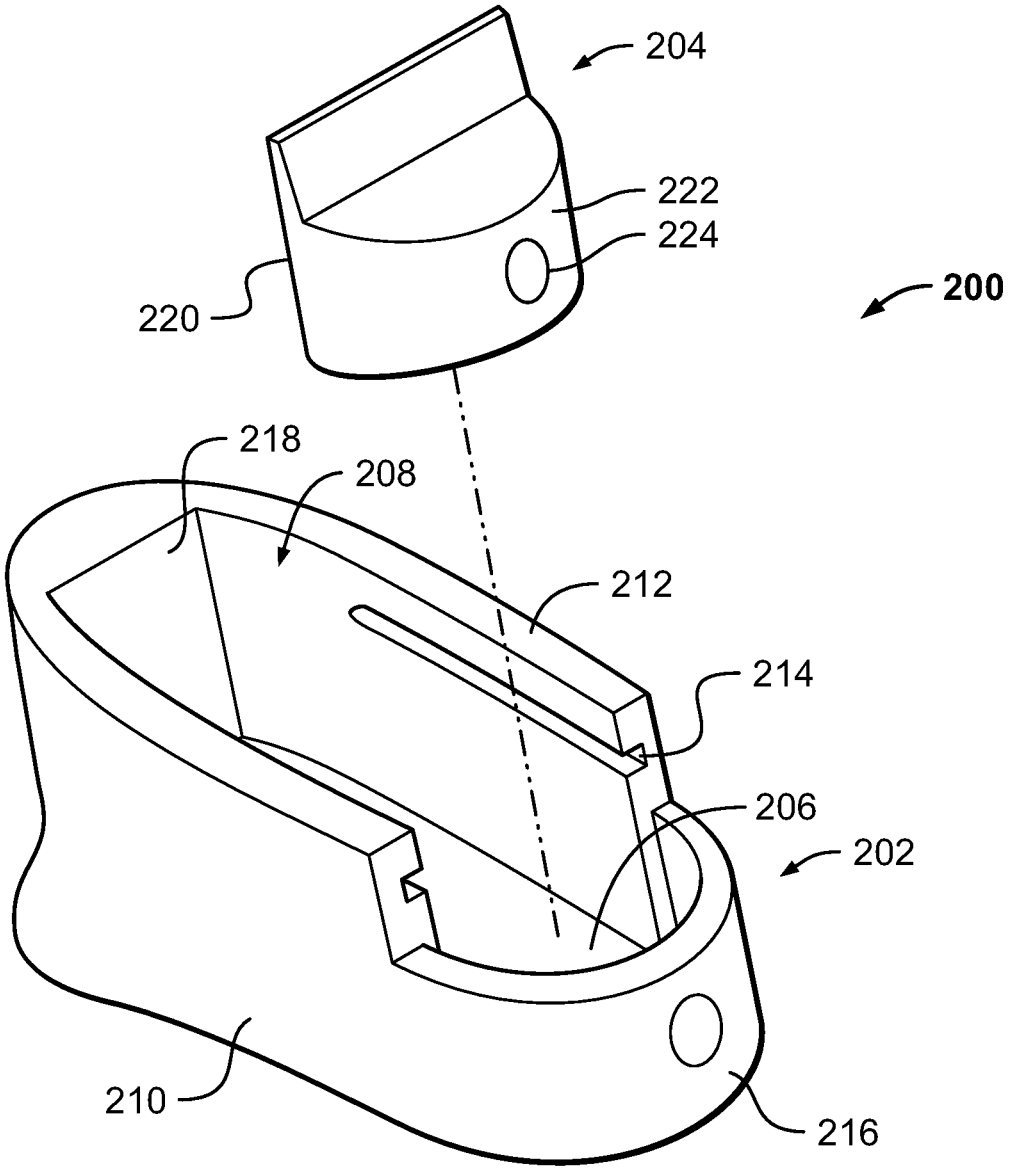
FIG. 2 shows a diagram of a magazine floor plate in accordance with one or more embodiments of the invention.

FIG. 2 illustrates a diagram of a magazine floor plate 200 in accordance with one or more embodiments of the invention. The magazine floor plate 200 with a circumferential locking mechanism that is adapted to reversibly, fixedly attach the magazine floor plate 200 to a firearm magazine. The magazine floor plate 200 may include a body portion 202 and a locking mechanism 204. Each of these portions of the magazine floor plate 200 are discussed below.

The body portion 202 may include a base plate 206 (also described as the magazine floor plate), a first and second parallel longitudinal sidewall, and a first and second parallel traverse sidewall. The aforementioned elements of the body portion 202 may be connected in a manner that forms an interior cavity 208 where a firearm magazine and a locking mechanism 204 may be inserted for attachment purposes.

When inserted into the interior cavity 208, the firearm magazine and the locking mechanism 204 may be received by the interior cavity. When received by the interior cavity, the firearm magazine may be reversibly, fixedly attached to the firearm magazine floor plate.

The base plate 206 (also described as the magazine floor plate), first and second parallel longitudinal sidewalls, and first and second parallel traverse sidewalls may be connected in a permanent manner. For example, the aforementioned features may be welded together, formed by injection molding techniques, or other methods commonly that may facilitate the reversible and/or permanent attachment of the aforementioned features of the body portion 202. The aforementioned features may be composed of a semi rigid material such as plastic, metal, wood, polyvinyl chloride, polyethylene terephthalate, and/or other suitable materials. However, other alternatives are contemplated. For example, the aforementioned features may be 3D printed as a single piece or multiple pieces that are later attached.

The base plate 206 may be attached to the first parallel longitudinal sidewall 210 and second parallel longitudinal sidewall 212 and the first and second parallel traverse sidewalls 216, 218. The first and second parallel longitudinal sidewalls 210, 212 and the first and second parallel traverse sidewalls 216, 218 may extend vertically from the base plate 206. The base plate 206 may form the floor of the interior cavity 208. However, other alternatives are contemplated. In some embodiments, the base plate 206 may be a single piece later attached to the other sidewalls 210, 212, 216, 218 or the base plate 206 may be part of a single piece of material along with the sidewalls 210, 212, 216, 218 in a production technique such as injection molding or 3D printing.

The first and second parallel longitudinal sidewalls 210, 212 may be adapted to receive one or more features disposed on a firearm magazine to which the magazine floor plate 200 is adapted to attach. For example, the first and second parallel longitudinal sidewalls 210, 212 may include a groove 214 adapted to receive a portion of a firearm magazine. In some embodiments, the first parallel longitudinal sidewall 210 may be parallel to the second parallel longitudinal sidewall 212 and allow for the groove 214 of the first and second parallel longitudinal sidewalls 210, 212 to be parallel within the same plane and on facing opposite surfaces defining the interior cavity 208. The first and second parallel longitudinal sidewalls 210, 212 may be attached to the base plate 206 and extend vertically from the base plate 206. The first and second parallel longitudinal sidewalls 210, 212 may be part of a single piece of material.

The first and second parallel traverse sidewalls 216, 218 may form other boundaries of the interior cavity 208. The first parallel traverse sidewall 216 may be of a shorter length than the second parallel traverse sidewall 218. The first and second parallel traverse sidewalls 216, 218 may be parallel to each other. The first and second parallel traverse sidewalls 216, 218 may be facing each other as opposite sidewalls of the interior cavity 208. The first and second parallel traverse sidewalls 216, 218 may be attached to the base plate 206 and extend vertically from the base plate 206. In other embodiments, the first and second parallel traverse sidewalls 216, 218 may be part of a single piece of material.

The first parallel traverse sidewall 216 may have a feature adapted to engage with the locking mechanism 204. The feature may be, for example, a notch that is adapted to engage with a corresponding feature of the locking mechanism 204. The corresponding feature may be, for example, a protrusion. When engaged, the feature and the complimentary feature may create an interference that reversibly, fixedly attaches the locking mechanism 204 to the body portion 202. The feature disposed on the first parallel traverse sidewall 216 may be on an interior surface of the first parallel traverse sidewall 216 that defines a side of the interior cavity 208. The first parallel traverse sidewall may be constructed of a semi-rigid material facilitating disengagement of the feature by application of pressure on an exterior surface of the first parallel traverse sidewall 216. Doing so may disengage the locking mechanism 204 from the body portion 202.

The locking mechanism 204 may be adapted to be inserted into a portion of the interior cavity 208 of the body portion 202 between the firearm magazine and one or more of the sidewalls 210, 212, 216, 218. When so inserted, the locking mechanism 204 may be reversibly, fixedly attached to the body portion 202. When the locking mechanism 204 is attached to the body portion 202, the locking mechanism 204 and the body portion 202 may circumferentially attach to a firearm magazine that is partially disposed in the interior cavity 208. For additional details regarding the circumferential attachment, refer to FIGS. 3-8.

The locking mechanism 204 may include a first surface 220 adapted to contact a firearm magazine disposed in an interior cavity 208. The first surface of the locking mechanism 204 may have a height greater than the height difference between the feature on the interior surface of the first parallel traverse sidewall 216 and the groove of the first and second parallel longitudinal sidewalls 210, 212. The locking mechanism may include a second surface 222 adapted to contact the interior surface of the first parallel traverse sidewall 216. A second surface 222 of the locking mechanism may include a complementary feature (e.g., a protrusion 224) adapted to engage the feature (e.g., a notch or other type of recess) of the interior surface of the first parallel traverse sidewall 216.

The locking mechanism 204 may be constructed of a semi-rigid material allowing the locking mechanism 204 to be disengaged when pressure is applied from an exterior surface of the first parallel traverse sidewall 216. The locking mechanism 204 may have a shape that is complementary to the shape of a portion of the interior cavity 208 that is empty after a firearm magazine is inserted into the interior cavity 208. In other words, the locking mechanism may fill all, or a portion, of the remaining space of the interior cavity 208 that is empty after insertion of a firearm magazine into the interior cavity 208.

As discussed above, the locking mechanism may prevent and/or limit the firearm magazine from disengaging from the grooves 214 of the first and second parallel longitudinal sidewalls 210, 212 by closing off the opening through which the firearm magazine was inserted into the grooves 214 of the first and second parallel longitudinal sidewalls 210, 212 and, consequently, form a circumferential attachment to the firearm magazine.

Figure 3:
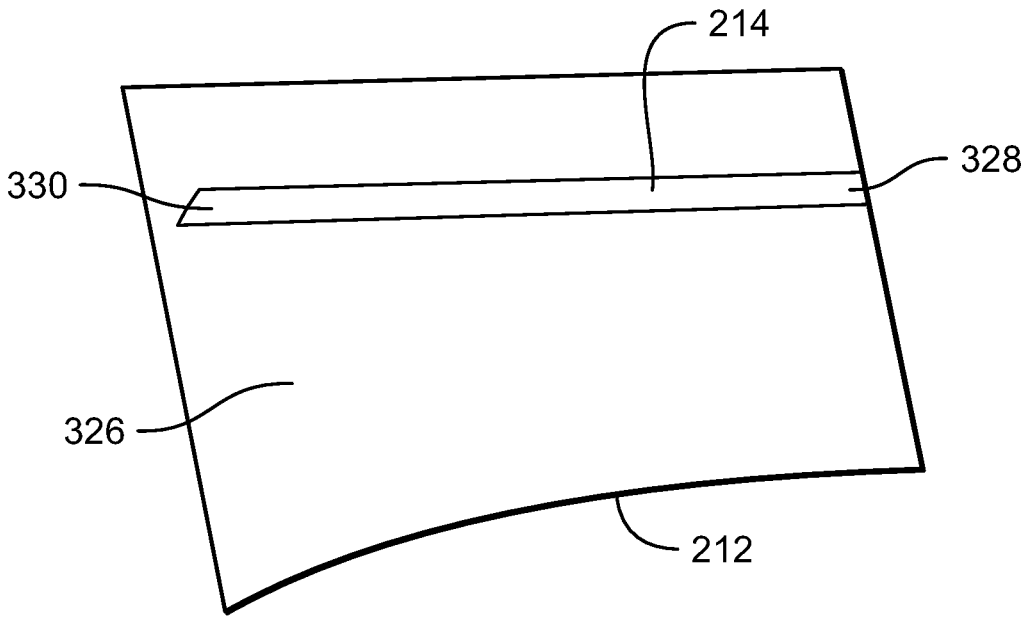
FIG. 3 shows a diagram of a sidewall of a magazine floor plate in accordance with one or more embodiments of the invention.

FIG. 3 shows a diagram of the second parallel longitudinal sidewall 212 of the magazine floor plate 200 in accordance with one or more embodiments of the invention. The first parallel longitudinal sidewall 210 may be similar to the second parallel longitudinal sidewall 212. The first and second parallel longitudinal sidewalls 210, 212 may include a groove 214 (or other type of feature(s)) to engage with the firearm magazine. The groove 214 of the first and second parallel longitudinal sidewalls 210, 212, may be located on an interior surface 326 of the first and second parallel longitudinal sidewalls 210, 212 that define the interior cavity 208 of the body portion 202. The groove 214 may be adapted to allow a portion of the firearm magazine to be inserted into an entry point 328 of the groove 214 and then allow the firearm magazine to slide along the groove 214 until the firearm magazine reaches the end point 330 of the groove 214.

Figure 4A:
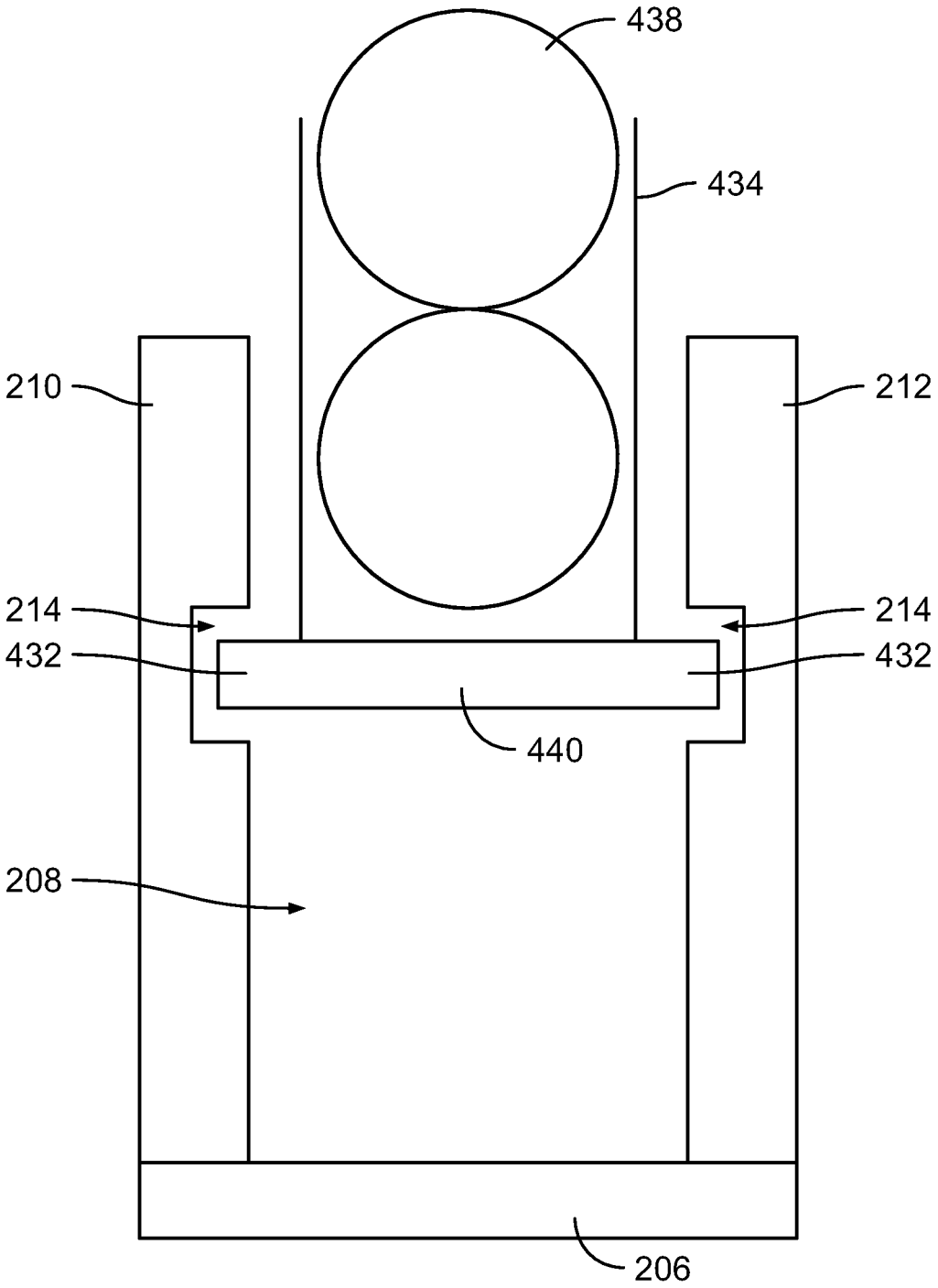
FIG. 4A shows a diagram of a magazine floor plate engaged with a firearm magazine in accordance with one or more embodiments of the invention.

FIG. 4A shows a cross section cutout view of a firearm magazine engaging with the magazine floor plate 200 in accordance with one or more embodiments of the invention. To facilitate the engagement, the grooves 214 of the first and second parallel longitudinal sidewalls 210, 212, may include a recessed area that engages a flange 432 (or another type of physical feature) of a firearm magazine 434 disposed on an exterior surface of the firearm magazine 434. The grooves 214 may be adapted to prevent the firearm magazine 434 from exiting vertically from the interior cavity 208.

In FIG. 4A, the firearm magazine 434 may include a plate 440 that prevents ammunition 438 from exiting the bottom of the firearm magazine 434.

Figure 4B:
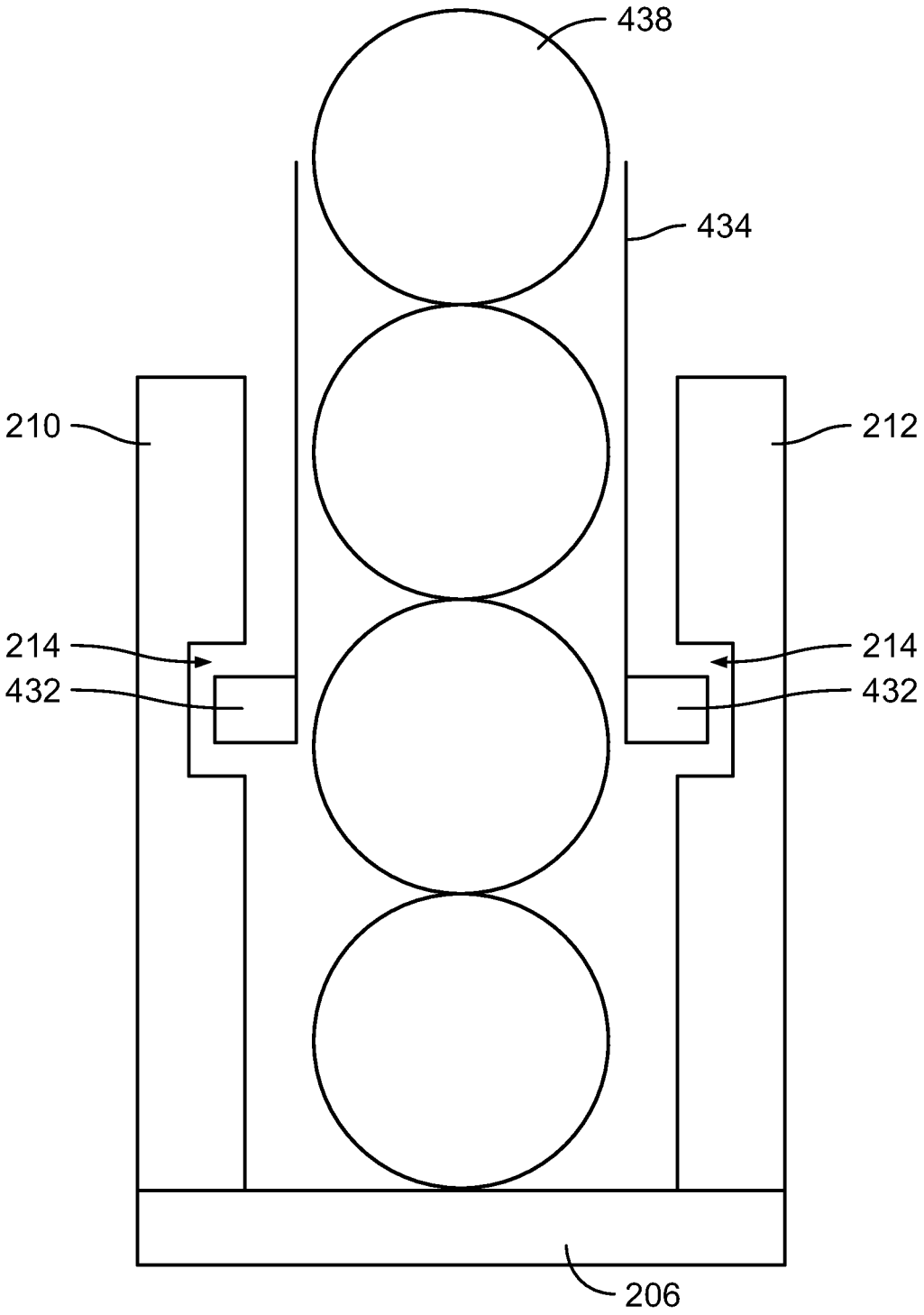
FIG. 4B shows a second diagram of a magazine floor plate engaged with a firearm magazine in accordance with one or more embodiments of the invention.

FIG. 4B shows a cross section cutout view of a firearm magazine engaging with the magazine floor plate and allowing for an increased ammunition capacity of the firearm magazine 434 in accordance with one or more embodiments of the invention. The firearm magazine 434 may lack a plate 440 shown in FIG. 4A. In such a scenario, the interior cavity 208 may allow for additional ammunition 438 to be loaded into the firearm magazine 434 by extending the bottom of the firearm magazine 434 to the lower end of the interior cavity 208 that is formed by the base plate 206. The extension height provided by the interior cavity 208 may be defined between the grooves 214 and the base plate 206.

Figure 5:
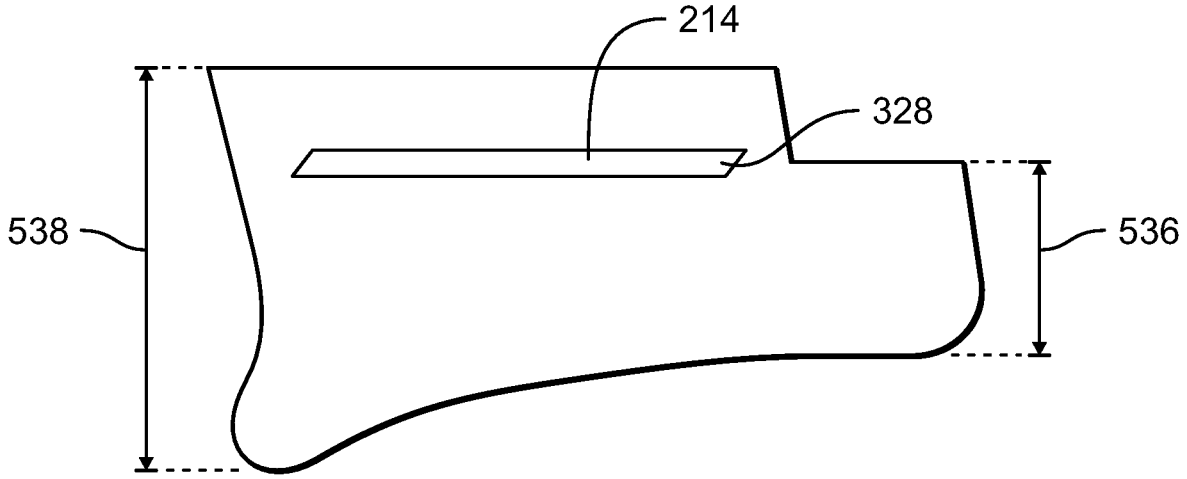
FIG. 5 shows a cut view diagram of a magazine floor plate in accordance with one or more embodiments of the invention.

FIG. 5 shows a cross section cutout view of a magazine floor plate 200 in accordance with one or more embodiments of the invention. The height of the first and second parallel longitudinal sidewalls 210, 212 may be the same. The height 536 of the first parallel traverse sidewall 216 may be less than the height 538 of the second parallel traverse sidewall 218.

Figure 6:
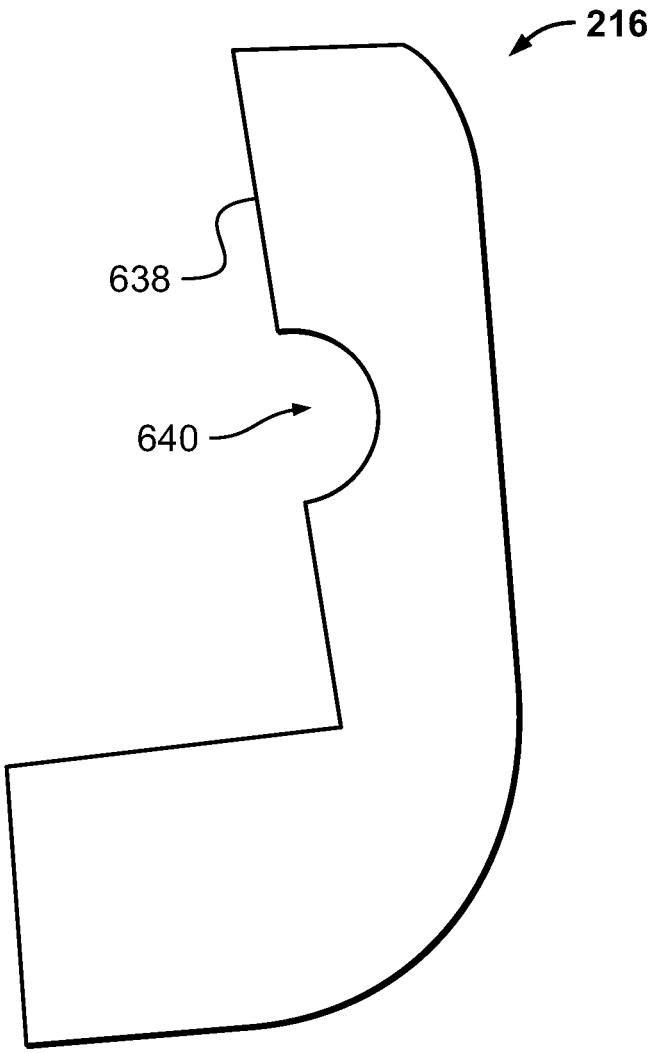
FIG. 6 shows a cut view diagram of a parallel traverse sidewall magazine floor plate in accordance with one or more embodiments of the invention.

FIG. 6 shows a cross section cutout view of the first parallel traverse sidewall illustrating the interior surface 638 of the first parallel traverse sidewall 216 defining a boundary of the interior cavity 208. The first parallel traverse sidewall 216 may include a complementary feature such as, for example, a notch 640 adapted to engage the locking mechanism 204 when the locking mechanism is disposed in the interior cavity 208.

Figure 7:
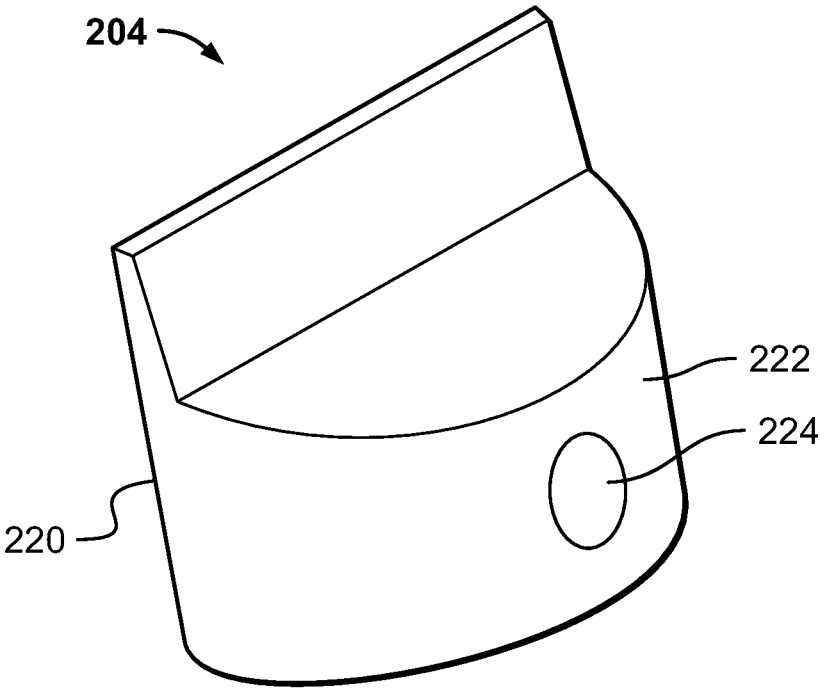
FIG. 7 shows a diagram of a locking mechanism in accordance with one or more embodiments of the invention.

FIG. 7 shows a diagram of a locking mechanism 204 in accordance with one or more embodiments of the invention. The locking mechanism 204 may include a first surface 220 adapted to contact the firearm magazine. The locking mechanism 204 may include a second surface 222 adapted to contact the interior surface of the first parallel traverse sidewall 216. The second surface 222 of the locking mechanism 204 may include a feature such as, for example, a protrusion 224 adapted to engage a complementary feature such as, for example, a 640, FIG. 6 notch of the interior surface of the first parallel traverse sidewall 216. The protrusion 224, when engaged with the notch 640 of the interior surface of the first parallel traverse sidewall 216, may prevent or otherwise limit the locking mechanism 204 from being removed from the interior cavity 208 of the body portion 202 when the firearm magazine is engaged with the magazine floor plate 200.

Figure 8:
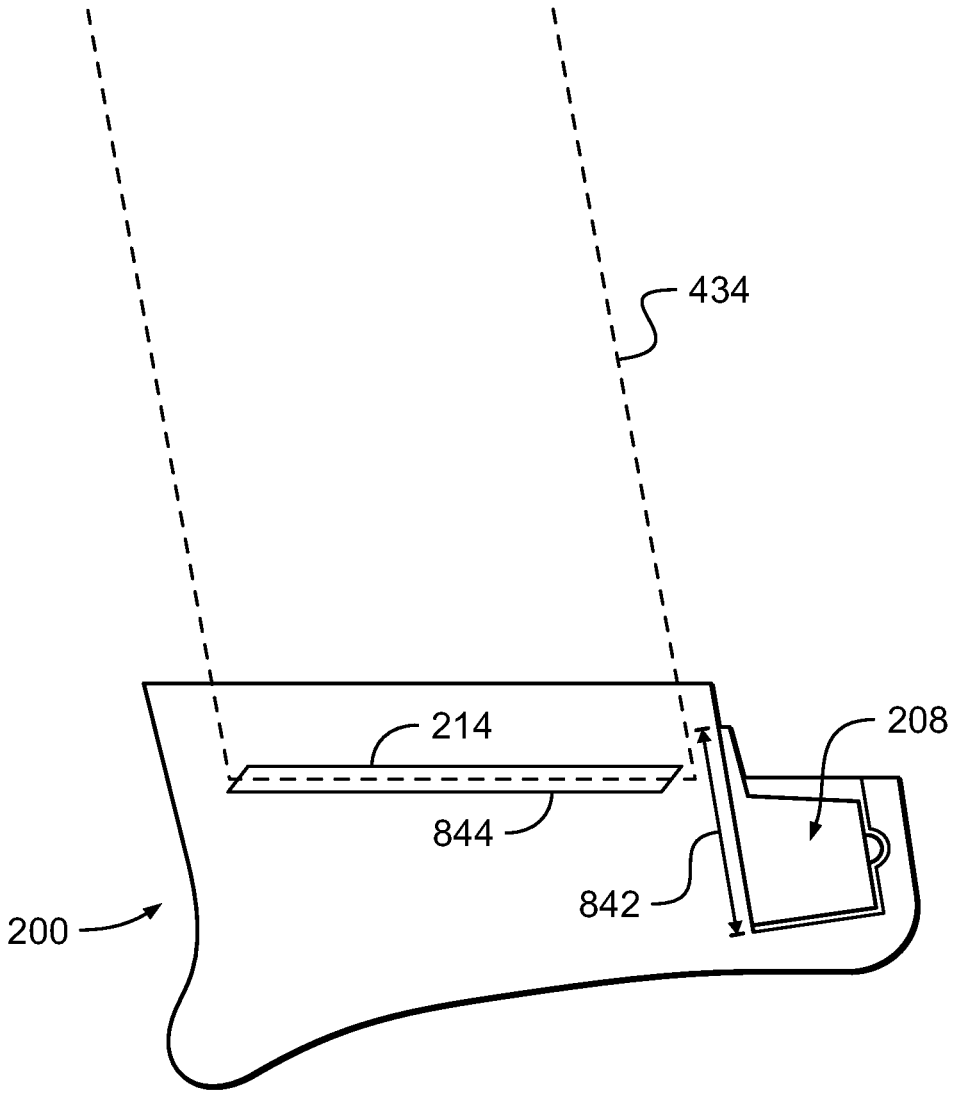
FIG. 8 shows a cut view diagram of a magazine floor plate and a locking mechanism in accordance with one or more embodiments of the invention.

FIG. 8 shows a cross section cutout view of a magazine floor plate 200 with a locking mechanism 204 engaged in accordance with one or more embodiments of the invention. Specifically, FIG. 8 illustrates a scenario where the locking mechanism 204 may be inserted into the interior cavity 208 of the magazine floor plate 200 while a magazine is disposed within the interior cavity 208. The height 842 of the locking mechanism 204 in FIG. 8 may be greater than the lower end 844 of the groove to prevent the firearm magazine from being disengaged from the grooves of the first and second parallel longitudinal sidewalls by forming a circumferential attachment.

The height of the first surface of the locking mechanism 204 may be greater than the height between the notch of the interior surface of the first parallel traverse sidewall and the groove of the first and second parallel longitudinal sidewalls. The first surface of the locking mechanism may prevent or otherwise limit the firearm magazine from being removed from the magazine floor plate by circumferentially enclosing the groove that engages the firearm magazine.

As discussed above, the locking mechanism 204 may be reversibly, fixedly attached to the body portion of the magazine floor plate 200. To reverse such an attachment, a force may be applied to the first parallel traverse sidewall on the surface opposite of the interior surface include the notch (or other type of mechanism that may generate an interference between the locking mechanism 204 and the body portion 202) of the first parallel traverse sidewall. When the force is applied, it may cause the locking mechanism 204 to become disengaged from the first parallel traverse sidewall and allow for the locking mechanism 204 to be removed from the interior cavity 208 of the magazine floor plate 200. In another embodiment, after the locking mechanism is removed, the firearm magazine may be disengaged and removed from the magazine floor plate 200.

Figure 9:
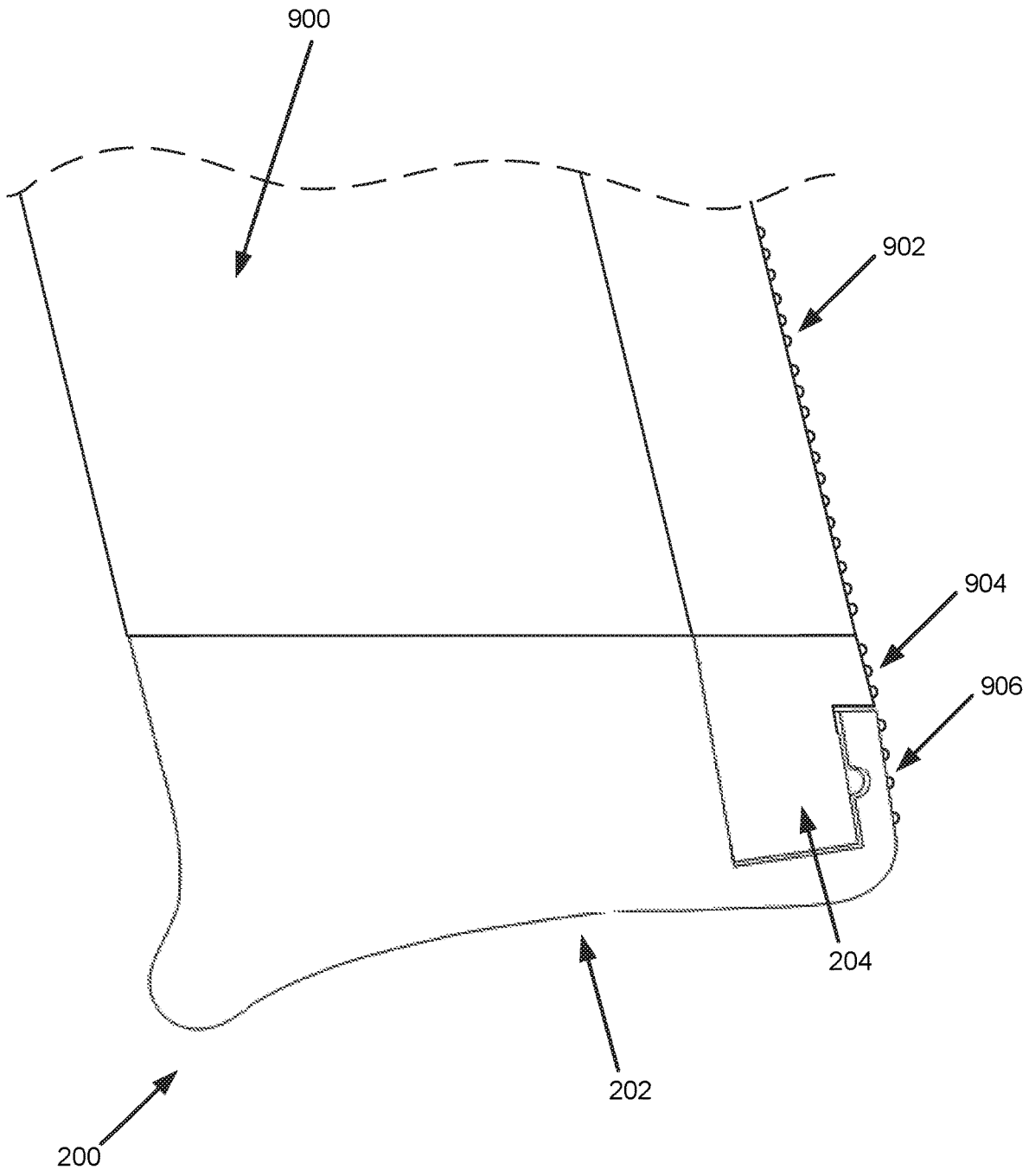
FIG. 9 shows a cut view diagram of a magazine floor plate and a handle of a firearm in accordance with one or more embodiments of the invention.

As discussed above, a magazine floor plate 200 in accordance with one or more embodiments of the invention may include physical features that extend or otherwise improve on existing ergonomic features of a firearm. FIG. 9 shows a diagram of a magazine floor plate 200 mated to a magazine that is disposed in handle 900 of a firearm in accordance with one or more embodiments of the invention.

As seen from FIG. 9, a handle 900 may include one or more ergonomic surfaces 902. Such surfaces may include physical features such as bumps or other types of texturing that improve the feel and/or use of the handle 900.

A magazine floor plate 200 in accordance with embodiments of the invention may include one or more ergonomic surface extensions 904, 906. Such ergonomic surface extensions 904, 906 may include features similar to that of the ergonomic surface 902 of the handle 900 that make the handle feel as though it is longer in length, width, etc.

For example, a first ergonomic surface extension 904 may be included on a locking mechanism 204 and/or a second ergonomic surface extension 906 may be included on a body portion 202. The aforementioned ergonomic surface extensions may be, when attached to a magazine, collocated next to each other. By doing so, both surfaces may cooperate to extend the dimensions of the ergonomic surface 902 of the handle 900.

Figure 10:
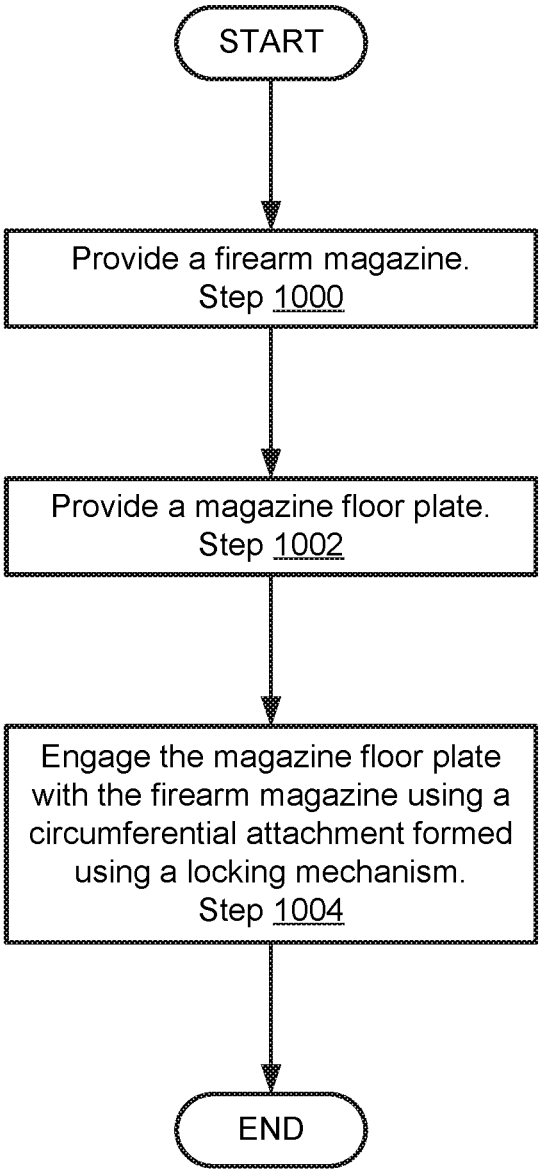
FIG. 10 shows a flowchart of a method of using a magazine floor plate in accordance with one or more embodiments of the invention.

To further clarify aspects of embodiments of the invention with respect to use of a magazine floor plate in accordance with embodiments of the invention, a flow chart of methods of using floor plates is shown in FIG. 10.

FIG. 10 shows a flowchart of a method in accordance with one or more embodiments of the invention. The method depicted in FIG. 10 may facilitate the use of a magazine floor plate in accordance with one or more embodiments of the invention. While FIG. 10 is illustrated as a series of steps, any of the steps may be omitted, performed in a different order, additional steps may be included, and/or any or all of the steps may be performed in a parallel and/or partially overlapping manner without departing from the invention.

In Step 1000, a firearm magazine is provided. The firearm magazine may be adapted to receive an internal locking floor plate.

In Step 1002, a magazine floor plate that circumferentially attaches to magazines is provided. The magazine floor plate may include a plurality of walls that cause the magazine floor plate to engage with the firearm magazine obtained in step 1000.

In Step 1004, the magazine floor plate is engaged with the firearm magazine using the circumferential attachment. The circumferential attachment may be formed by inserting a locking mechanism into a portion of a cavity that also engages with the firearm magazine.

In one or more embodiments of the invention, the magazine floor plate of step 1002 includes a plurality of sidewalls extending vertically from the magazine floor plate and defining an interior cavity adapted to accommodate a portion (e.g., flanges or other features) of the firearm magazine. The plurality of sidewalls may include a first and second parallel longitudinal sidewall and a first and second parallel traverse sidewall; the first and second parallel longitudinal sidewall each may have a length greater than the firearm magazine. The magazine floor plate may further include a locking mechanism adapted to be inserted between the firearm magazine and at least one of the plurality of sidewalls.

The method of FIG. 10 may further include causing a firearm magazine ammunition spring to be inserted into the interior cavity of the magazine floor plate to provide extra ammunition capacity of the firearm magazine.

The method of FIG. 10 may further include causing a force on at least one of the plurality of sidewalls causing the locking mechanism to disengage from the firearm magazine and the at least one of the plurality of sidewalls.

The method of FIG. 10 may further include removing the locking mechanism from between the firearm magazine and at least one of the plurality of sidewalls preventing movement of the firearm magazine.

The method of FIG. 10 may further include disengaging and removing the magazine floor plate from the firearm magazine.

Embodiments of the present invention are further illustrated by the non-limiting examples which follow.

The preceding example(s) can be repeated with similar success by substituting the various components and configurations for others discussed elsewhere in this application.

Embodiment 1

A magazine floor plate for a firearm magazine, comprising: a plurality of sidewalls extending vertically from the magazine floor plate and defining an interior cavity configured to accommodate the firearm magazine, wherein the plurality of sidewalls include a first and second parallel longitudinal sidewall and a first and second parallel traverse sidewalls; the first and second parallel longitudinal sidewalls have a length greater than the firearm magazine; and a locking mechanism configured to be inserted between the firearm magazine and at least one of the plurality of sidewalls.

Embodiment 2

The magazine floor plate of embodiment 1, wherein at least one of the plurality of sidewalls comprise a groove on an interior surface defining the interior cavity.

Embodiment 3

The magazine floor plate of embodiment 2, wherein the groove of the at least one of the plurality of sidewalls is configured to receive the firearm magazine.

Embodiment 4

The magazine floor plate of embodiment 1, wherein the first and second parallel longitudinal sidewalls have an interior surface defining the interior cavity and comprise a groove configured to receive the firearm magazine.

Embodiment 5

The magazine floor plate of embodiment 4, wherein an extension height defined between the groove and the magazine floor plate is configured to enclose ammunition of the firearm magazine and working components of the firearm magazine.

Embodiment 6

The magazine floor plate of embodiment 4, wherein the first parallel traverse sidewall has a maximum height less than the groove of the first and second parallel longitudinal sidewalls.

Embodiment 7

The magazine floor plate of embodiment 6, wherein the first parallel traverse sidewall has an interior surface defining the interior cavity and is configured to receive the locking mechanism.

Embodiment 8

The magazine floor plate of embodiment 7, wherein the interior surface of the first parallel traverse sidewall comprises a notch configured to receive the locking mechanism.

Embodiment 9

The magazine floor plate of embodiment 8, wherein the locking mechanism has a first surface configured to contact the firearm magazine and the first surface of the locking mechanism has a height greater than the height between the notch of the interior surface of the first parallel traverse sidewall and the groove of the first and second parallel longitudinal sidewalls.

Embodiment 10

The magazine floor plate of embodiment 9, wherein the locking mechanism has a second surface configured to contact the interior surface of the first parallel traverse sidewall and comprises a protrusion configured to engage the notch of the interior surface of the first parallel traverse sidewall.

Embodiment 11

A magazine floor plate for a firearm magazine comprising: a plurality of sidewalls defining an interior cavity and extending vertically from the magazine floor plate; the interior cavity configured to receive the firearm magazine and having a length greater than the firearm magazine; and a locking mechanism configured to be inserted between the firearm magazine and at least one of the plurality of sidewalls.

Embodiment 12

The magazine floor plate of embodiment 11, wherein the size of the locking mechanism is the difference between the length of the interior cavity and the length of the firearm magazine.

Embodiment 13

The magazine floor plate of embodiment 12, wherein the plurality of sidewalls include a first and second parallel longitudinal sidewall defining a length of the interior cavity.

Embodiment 14

The magazine floor plate of embodiment 13, wherein the plurality of sidewalls include a first and second parallel traverse sidewall defining the width of the interior cavity.

Embodiment 15

The magazine floor plate of embodiment 14, wherein the first and second parallel longitudinal sidewalls comprise an interior surface defining the interior cavity and comprising a notch configured to receive the firearm magazine.

Embodiment 16

A method of using a magazine floor plate for a firearm magazine, the method comprising: providing a firearm magazine; providing a magazine floor plate, the magazine floor plate comprising a plurality of sidewalls extending vertically from the magazine floor plate and defining an interior cavity configured to accommodate the firearm magazine, wherein the plurality of sidewalls include a first and second parallel longitudinal sidewall and a first and second parallel traverse sidewalls; the first and second parallel longitudinal sidewalls have a length greater than the firearm magazine; and a locking mechanism configured to be inserted between the firearm magazine and at least one of the plurality of sidewalls; causing the magazine floor plate to engage with the firearm magazine; and causing the locking mechanism to be inserted between and engage with the firearm magazine and at least one of the plurality of sidewalls preventing movement of the firearm magazine.

Embodiment 17

The method of embodiment 16, further comprising, causing a firearm magazine ammunition spring to be inserted into the interior cavity of the magazine floor plate to provide extra ammunition capacity of the firearm magazine.

Embodiment 18

The method of embodiment 16, further comprising, causing a force on at least one of the plurality of sidewalls causing the locking mechanism to disengage from the firearm magazine and the at least one of the plurality of sidewalls.

Embodiment 19

The method of embodiment 18, further comprising, removing the locking mechanism from between the firearm magazine and at least one of the plurality of sidewalls preventing movement of the firearm magazine.

Embodiment 20

The method of embodiment 19, further comprising, disengaging and removing the magazine floor plate from the firearm magazine.

Embodiments of the invention may provide methods, devices, and/or systems for managing firearm ammunition disposed in a magazine. Specifically, embodiments of the invention may facilitate the reversible, fixed attachment of a magazine floor plate that forms a circumferential attachment to a magazine that is adapted to receive an internally locking magazine floor plate. By circumferentially, rather than internally, attaching to the magazine, a magazine floor plate in accordance with embodiments of the invention may provide an improved magazine that may, for example, be capable of managing more rounds of ammunition than conventional magazines that utilize internally locking floor plates.

Additional embodiments of the invention may provide a method of extending the dimension of existing ergonomic surfaces disposed on firearms. Specifically, embodiments of the invention may provide a magazine floor plate that includes complementary ergonomic surfaces disposed at locations that extend the dimensions of existing ergonomic surfaces when the magazine floor plate is attached to a magazine. By doing so, the utility of a firearm may be improved.

The problems discussed above should be understood as being examples of problems solved by embodiments of the invention disclosed herein and the invention should not be limited to solving the same/similar problems. The disclosed invention is broadly applicable to address a range of problems beyond those discussed herein.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A magazine floor plate for a firearm magazine, comprising:

a plurality of sidewalls defining an interior cavity adapted to accommodate a portion of the firearm magazine, wherein the plurality of sidewalls comprises:

first and second parallel longitudinal sidewalls, first and second parallel transverse sidewalls; and a locking mechanism adapted to be inserted between the firearm magazine and a single sidewall of the plurality of sidewalls when the interior cavity accommodates the portion of the firearm magazine, the locking mechanism comprising a complementary feature shaped to engage with a feature of an interior surface of the single sidewall to retain the locking mechanism within the magazine floor plate only when the interior cavity accommodates the portion of the firearm magazine, wherein the first and second parallel longitudinal sidewalls have a length greater than the firearm magazine.

2. The magazine floor plate of claim 1, wherein at least one of the plurality of the sidewalls comprises a groove on an interior surface defining the interior cavity, wherein the groove is oriented in a first direction.

3. The magazine floor plate of claim 2, wherein inserting the locking mechanism comprises a movement of the floor plate in a second direction that is different from the first direction.

4. The magazine floor plate of claim 3, wherein inserting the locking mechanism further comprises, a second movement of a portion of the locking mechanism from a first side of the groove to a second side of the groove.

5. The magazine floor plate of claim 4, wherein when the firearm magazine accommodates the portion of the firearm magazine, the firearm magazine is disposed entirely above a lower end of the groove.

6. The magazine floor plate of claim 1, wherein the plurality of the sidewalls and the locking mechanism are adapted to circumferentially enclose a portion of the firearm magazine.

7. The magazine floor plate of claim 6, wherein the locking mechanism is adapted to be reversibly inserted into a portion of the interior cavity.

8. The magazine floor plate of claim 7, wherein the locking mechanism is adapted to create an interference with the firearm magazine when reversibly inserted into the portion of the interior cavity.

9. The magazine floor plate of claim 6, wherein the circumferential enclosure of the portion of the firearm magazine does not obstruct an opening in the firearm magazine where the plurality of the sidewalls is adapted to accommodate the portion of the firearm magazine.

10. The magazine floor plate of claim 1, wherein the locking mechanism is adapted to enable it to be removed from the interior cavity while the firearm magazine is not attached to a firearm.

11. A magazine floor plate for a firearm magazine, comprising:

a plurality of sidewalls defining an interior cavity, wherein the plurality of sidewalls extends vertically from a floor plate;

the interior cavity adapted to receive a portion of the firearm magazine, wherein the interior cavity has a length greater than the portion of the firearm magazine; and a locking mechanism adapted to be inserted between the firearm magazine and single sidewall of the plurality of the sidewalls when the interior cavity receives the portion of the firearm magazine, the locking mechanism comprising a complementary feature shaped to engage with a feature of an interior surface of the single sidewall to retain the locking mechanism within the magazine floor plate only when the interior cavity accommodates the portion of the firearm magazine.

12. The magazine floor plate of claim 11, wherein at least one of the plurality of the sidewalls comprises a groove on an interior surface defining the interior cavity, wherein the groove is oriented in a first direction.

13. The magazine floor plate of claim 12, wherein inserting the locking mechanism comprises a movement of the floor plate in a second direction that is different from the first direction.

14. The magazine floor plate of claim 13, wherein inserting the locking mechanism further comprises, a second movement of a portion of the locking mechanism from a first side of the groove to a second side of the groove.

15. The magazine floor plate of claim 14, wherein when the interior cavity receives the portion of the firearm magazine, the firearm magazine is disposed entirely above a lower end of the groove.

16. A method of using a magazine floor plate for a firearm magazine, the method comprising:

providing a firearm magazine;

providing a magazine floor plate, the magazine floor plate comprising a plurality of sidewalls extending vertically from the magazine floor plate and defining an interior cavity adapted to accommodate the firearm magazine, wherein the plurality of the sidewalls comprises:

first and second parallel longitudinal sidewalls, wherein the first and second parallel longitudinal sidewalls have a length greater than the firearm magazine first and second parallel transverse sidewalls, and a locking mechanism adapted to be inserted between the firearm magazine and a single sidewall of the plurality of the sidewalls, the locking mechanism comprising a complementary feature shaped to engage with a feature of an interior surface of the single sidewall to retain the locking mechanism within the magazine floor plate only when the interior cavity accommodates the portion of the firearm magazine; and causing the magazine floor plate to engage with the firearm magazine; and causing the locking mechanism to be inserted between and engage with the firearm magazine and the single sidewall of plurality of sidewalls preventing movement of the firearm magazine with respect to the magazine floor plate.

17. The method of claim 16, wherein at least one of the plurality of the sidewalls comprises a groove on an interior surface defining the interior cavity, wherein the groove is oriented in a first direction.

18. The method of claim 17, wherein inserting the locking mechanism comprises a movement of the floor plate in a second direction that is different from the first direction.

19. The method of claim 18, wherein inserting the locking mechanism further comprises, a second movement of a portion of the locking mechanism from a first side of the groove to a second side of the groove.

20. The method of claim 19, wherein when the firearm magazine accommodates the portion of the firearm magazine, the firearm magazine is disposed entirely above a lower end of the groove.

* * * * *